United States Patent [19]

McMahon et al.

[11] 4,325,546

[45] Apr. 20, 1982

[54] MODULAR ATHLETIC PLAYING SURFACE WITH TUNED COMPLIANCE

[76] Inventors: Thomas A. McMahon, 65 Crest Rd., Wellesley, Mass. 02181; Peter R. Greene, 77 Lanark Rd., Brookline, Mass. 02146

[21] Appl. No.: 110,671

[22] Filed: Jan. 9, 1980

Related U.S. Application Data

[63] Continuation-in-part of Ser. No. 947,101, Sep. 29, 1978, which is a continuation-in-part of Ser. No. 826,335; Aug. 22, 1977, abandoned.

[51] Int. Cl.[3] ..... A63C 19/00

[52] U.S. Cl. ..... 272/3; 52/480; 272/109; 404/35

[58] Field of Search ..... 272/2, 3, 4, 5, 56.5 SS, 272/70, 100, 101, 109, 134, 135, 136, 137; 14/73; 404/17, 29, 18, 31, 34, 35, 37, 38, 39, 46; 52/384, 385, 386, 387, 479, 480, 481

[56] References Cited

U.S. PATENT DOCUMENTS

| | | | |
|---|---|---|---|
| 7,933 | 2/1851 | Ware . | |
| Re. 17,020 | 7/1928 | Healy | 52/387 X |
| 92,793 | 7/1869 | Butler | 272/137 |
| 357,144 | 2/1887 | Buttler | 52/384 X |
| 738,174 | 9/1903 | Erwin . | |
| 750,954 | 2/1904 | Ellis . | |
| 1,233,200 | 7/1917 | Dessau . | |
| 1,509,750 | 9/1924 | Campbell . | |
| 1,693,655 | 12/1928 | Murphy . | |
| 1,747,352 | 2/1930 | Devine, Jr. . | |
| 2,068,386 | 1/1937 | Otis . | |
| 2,167,696 | 8/1939 | Tetzman . | |
| 2,263,895 | 11/1941 | Larsen | 52/480 |
| 2,369,733 | 2/1945 | Greulich | 404/35 |
| 3,045,294 | 7/1962 | Livezey . | |
| 3,114,940 | 12/1963 | Rockabrand et al. . | |
| 3,271,916 | 9/1966 | Omholt . | |
| 3,438,312 | 4/1969 | Becker et al. . | |
| 3,575,780 | 4/1971 | Trieschmann . | |
| 3,634,895 | 1/1972 | Childers . | |
| 3,641,601 | 2/1972 | Sieg . | |
| 3,779,547 | 12/1973 | Pappas . | |
| 3,844,539 | 10/1974 | Abbott . | |
| 3,922,409 | 11/1975 | Stark . | |
| 4,054,987 | 10/1977 | Forlenza . | |
| 4,198,042 | 4/1980 | Olson | 272/3 |

FOREIGN PATENT DOCUMENTS

| | | | |
|---|---|---|---|
| 1021997 | 2/1958 | Fed. Rep. of Germany . | |
| 2316887 | 10/1973 | Fed. Rep. of Germany . | |
| 2738297 | 3/1979 | Fed. Rep. of Germany | 272/109 |
| 1071921 | 4/1954 | France . | |
| 2240320 | 3/1975 | France . | |
| 2414340 | 9/1979 | France | 272/109 |
| 2419084 | 11/1979 | France | 272/109 |
| 200728 | 7/1923 | United Kingdom . | |
| 1113244 | 5/1968 | United Kingdom . | |
| 1201226 | 8/1970 | United Kingdom . | |
| 1226445 | 3/1971 | United Kingdom . | |
| 1244157 | 8/1971 | United Kingdom . | |
| 1263731 | 2/1972 | United Kingdom . | |
| 1478850 | 7/1977 | United Kingdom . | |
| 596256 | 3/1978 | U.S.S.R. . | |

OTHER PUBLICATIONS

Hewetson-Springbok Resilient Flooring System, Jul. 1978, J. A. Hewetson & Company Limited.

Hewetson-Valtor Lockable Sprung Dance Floor, Jul. 1978, J. A. Hewetson & Company Limited.

*Primary Examiner*—Richard J. Apley
*Assistant Examiner*—Arnold W. Kramer
*Attorney, Agent, or Firm*—Kenway & Jenney

[57] ABSTRACT

A closely spaced array of modules forms an athletic playing surface characterized by a high degree of vertical compliance, an extreme resistance to lateral shear, and a high degree of uniformity of response. Each module has a laminated construction that includes a pair of stiffly resilient plates in a generally parallel, spaced relationship. One or more spacer plates and a plurality of resilient members are "sandwiched" between the plates. The lower plate is supported on a frame that allows it to flex in response to an applied force, typically the impact of a runner's foot on the upper plate. The spacer plate is configured, positioned, and secured to the upper and lower plates to mechanically couple them in a manner that, to a large degree, compensates for a non-uniformity of the deflection response of the module introduced by the frame support. The resilient members are selected and positioned to provide a substantially uniform deflection response at the upper plate. In the preferred form, the module has a set of hold-down bolts that extend between the upper and lower plates at points remote from the spacer plate or plates. The bolts limit the maximum vertical spacing between the plates and provide a convenient adjustment of both the vertical compliance of the module and the level of the upper plate. Also, the edges of adjacent upper plates preferably carry a set of control tabs, each secured to one plate and extending under the adjacent plate, to control the maximum vertical displacement between the adjacent edges.

25 Claims, 12 Drawing Figures

MODULAR ATHLETIC PLAYING SURFACE WITH TUNED COMPLIANCE

This application is a continuation-in-part of U.S. application Ser. No. 947,101 filed Sept. 29, 1978, which in turn is a continuation-in-part of U.S. application Ser. No. 826,335 filed Aug. 22, 1977 and now abandoned.

BACKGROUND OF THE INVENTION

This invention relates in general to athletic running and playing surfaces. More specifically, it relates to a surface composed of an array of modules having a laminated construction. The present invention is an improvement over the invention described in applicants' aforementioned applications.

Known athletic playing surfaces, particularly outdoor surfaces such as running tracks, football fields, and basketball courts are typically dirt, grass, asphalt or gravel over dirt. More recently, such surfaces have been constructed with a layer of a resilient synthetic plastic material, usually polyurethane, laid over a rigid substrate such as the asphalt or concrete. These plastic materials, such as the product sold under the trade designations "Astroturf", "Chem-Turf" or "Tartan" generally have a uniform composition and thickness when used as an athletic playing surface. All of these surfaces are characterized by a relatively high degree of rigidity (a low degree of vertical compliance). This characteristic results in a high incidence of injuries such as shin splints and foot injuries due to the high collision forces generated by the human leg striking a rigid surface when running. These problems are, of course, accentuated for competitive runners and those who are not in their best physical condition.

While these plastic surfaces enjoy a high degree of commercial success, they are not entirely satisfactory. First, while relatively thick resilient layers can reduce running induced injuries, the resilient material is usually only thick enough to enhance traction, reduce damage to the underlying surface from shoe spikes and reduce maintenance. In such thin layers, typically $\frac{3}{8}$ to $\frac{1}{2}$ inch, the running surface has been found to produce a relatively high level of injuries. Second, when the plastic layers are thick enough to significantly reduce injuries, they are poor running surfaces due to a relatively large degree of lateral compliance or low resistance to horizontal shear under an applied horizontal force and a high dependance of vertical compliance on the foot contact area, e.g., full foot versus only toe or heel contact. Third, they are comparatively expensive to install, particularly in thick layers necessary to achieve a relatively large degree of compliance. Fourth, when these plastic materials are used outdoors sunlight, temperature cycling, and exposure to adverse climatic conditions cause them to harden.

One solution to some of the foregoing problems that is commonly utilized in outdoor football fields is to place a resilient pad between the upper synthetic plastic layer and the underlying rigid substrate. While the resulting surface does have an enhanced softness, the degree of vertical compliance is not large enough to significantly reduce injuries or to provide what the applicants have found to be an optimal degree of compliance. Another problem with this pad design is that the resultant structure has a rather large degree of horizontal compliance (susceptibility to lateral shear). This is highly undesirable for running because (1) the energy transiently stored in the lateral deformation of the material is not returned to the runner and (2) foot control is poor. In addition, the pad material (often foam rubber), when compressed, is characterized by a generally low level of efficiency in transiently storing and returning energy to the runner. Further, in outdoor applications where the uppermost layer is a porous, woven synthetic material that simulates grass, rain can completely saturate the foam pad. It usually requires 24 to 48 hours of dry weather to restore the surface to its normal condition.

Heretofore conventional indoor athletic surfaces such as running tracks, basketball courts, and enclosed racket courts have used an extremely stiff upper surface laid on elongated support members or "sleepers". Many older tracks and basketball courts use stiff planks of hardwood that are interlocked with one another and secured to the sleepers. More recent running track designs have used other surface materials such as plywood panels over-laid with resilient materials of the type discussed above. In either case, it was assumed heretofore that the surface should be rigid (have an extremely low vertical compliance) to yield the best performance. Some other track designs have used plywood panels supported on several 2×4 inch wooden beams oriented perpendicular to the running direction. Such tracks provide some vertical compliance, but the degree of compliance varies greatly depending on whether or not a runner lands over a support beam. In these prior art surfaces, it is common for the compliance, as measured by a load deflection test, to vary over the surface by a factor of 10 (a non-uniformity of 1,000%) or more. This makes it difficult for a runner to maintain a uniform stride.

U.S. Pat. Nos. 1,693,655; 3,114,940; 3,045,294; and 3,271,916 and U.K. Pat. Nos. 1,113,244 and 1,478,850 describe floor constructions where hardwood boards or panels are supported on sleepers, but which also have a yielding material to provide some degree of cushioning. While these arrangements do provide some "give" to the floor, they have disadvantages when used as an athletic surface, particularly a running track. First, the yielding materials described in these patents are not highly resilient and therefore they absorb a substantial portion of the athlete's vertical kinetic energy each time he impacts on the surface. Second, for most of these constructions the compliance of the surface is not uniform. Third, there is no appreciation in this prior art of a general interrelationship between the vertical compliance of the running surface and the running speeds attainable on that surface other than the long accepted understanding that the hardest surface produces the fastest speed.

Further, the advantages of the yielding material in these constructions are overshadowed by other aspects of the construction, particularly the construction of the upper, wooden layer. In the '655, '940, and '294 patents the upper surface is formed by conventional interfitted (i.e. tongue-in-groove) floor boards or boards that are interlocked through flanged support rails. In the '916, '244, and '850 patents the upper surface is formed by larger panels which are mechanically coupled to one another. Because all of these upper layers are thus interconnected, they each (1) present a large apparent mass to the runner and (2) feed energy across the floor boards resulting in a phenomenon known as "cross-talk". As an example of cross-talk, if a runner lands on one end of a board or panel that is supported on a sleeper near its mid point, the board or panel can act like a lever causing the opposite end of the board or panel to accelerate upwardly or to have an increased resistance to the impacting foot of another runner. In addition, the impact of a runner on a continuous or interlocked surface can generate bending waves in the surface which propagate energy away from the runner and make the surface noisy. These phenomena contribute to the large variations in the response of conventional surfaces.

All of the foregoing designs for athletic surfaces also suffer from a number of other disadvantages. First, even those designs which offer some degree of vertical compliance in the surface provide no way of adjusting the degree of that compliance. Second, many of the surfaces mentioned above, particularly those involving wooden panels or flooring, are not suitable for outdoor use. Third, none of the designs described above are suitable for retro-fitting an existing playing surface such as a running track or a basketball court to provide an optimal degree of vertical compliance. Fourth many of the constructions utilizing a yielding material involve special hardware, skilled construction techniques, and are generally expensive to manufacture. Finally, none of the designs described above allow the upper surface of the floor to be replaced readily to accommodate different uses of the playing surface.

It is therefore a principal object of this invention to provide an athletic playing surface construction that provides an optimal degree of vertical compliance in the surface which enhances the running speed of athletes performing on the surface, reduces the likelihood of injuries, and is comfortable to run upon.

Another object is to provide a playing surface with the foregoing advantages that has a vertical compliance which is highly uniform over its surface and is independent of the foot contact area.

Another object of the invention is to provide a surface which provides an extremely high resistance to lateral shear.

A still further object is to provide an athletic playing surface with the foregoing advantages that provides a low effective vertical mass and substantially eliminates cross-talk.

Yet another object of the invention is to provide an athletic playing surface with a vertical compliance that is conveniently adjustable.

Another object is to provide an athletic playing surface with the foregoing advantages which allows the upper layer or layers of the surface to be replaced to accommodate the different uses of the surface.

A still further object of the invention is to provide an athletic playing surface construction which can be used either indoors or outdoors.

Yet another object of the invention is to provide an athletic playing surface construction which can "retrofit" many existing, conventional surfaces.

A still further object of the invention is to provide a playing surface construction which lends itself to prefabrication resulting in a reduction in on-site construction costs.

SUMMARY OF THE INVENTION

A horizontally extending athletic playing surface characterized by a relatively large degree of vertical compliance is formed by a mosaic array of modules closely spaced apart from one another. Each module includes an upper plate and a lower plate both formed of a stiffly resilient material and held in a mutually spaced and generally parallel relationship. One or more spacer plates, typically a small section of the sheet material forming the plates, is secured to both the upper and lower plates in a face abutting relationship. A plurality of resilient members, preferably secured only to the lower plate, also span the gap between the upper and lower plates and together with the spacer plate or plates support the upper plate. The resilient members are formed of a highly resilient material such as a low durometer rubber or neoprene with a durometer value in the range of 15 to 25. The upper and lower plates themselves and the resilient members are characterized by a high degree of resilience and therefore they transiently store and return energy to an athlene on the surface with a high degree of efficiency.

The lower plate is supported at or near its periphery to allow the center portion of the lower plate to flex vertically. In one form the support structure is a wooden frame that engages the entire periphery of the lower plate. The lower plate and the frame are typically square, generally rectangular or on occassion trapezoidal in configuration. In another form, frame members extend continuously along two edges of the lower plate and for a short distance along the remaining two sides (facing C frames). With a rectilinear plate and a fully enclosed supporting frame, the sandwich spacer plate preferably has the same general plan form configuration as the upper and lower plates and is substantially centered on them. With the C frames and rectalinear plates, there are preferably two spacer plates, each trapezoidal in shape with their larger base adjacent and generally centered on the unsupported edge of the lower plate.

The plates can be formed from a variety of materials and with a wide variety of shapes and dimensions. Suitable materials include conventional plywood, fiberglass coated plywood, reinforced foamed plastic, fiberglass sheets, and other plastic materials exhibiting suitable qualities of strength, resilience, and fatigue resistance under repeated cyclic loading. Plastic or plastic encased materials are generally preferred for outdoor uses. In general, the spacer member or members are configured and positioned to stiffen the deflection response of the module in a manner which compensates for the non-uniform flexural response of the lower plate due to the presence of the supporting frame. The material, dimensions and location of the resilient members are selected to provide, in combination with the flexure of the plates and the action of the spacer coupled to the plates, a substantially uniform vertical deflection response (compliance) over the entire upper plate.

In the preferred form a set of hold-down bolts extend between the upper and lower plates at points remote from the spacer plate or plates and generally near the edges of the upper and lower plates. The hold-down bolts limit the maximum vertical spacing between the upper and lower plates while allowing the plates to move freely and toward one another in response to an applied vertical force. The hold-down bolts thus control intramodule cross-talk. They are preferably oriented for adjustment from the top surface of the module. Selective tightening of the hold-down bolts therefore allows a convenient arrangement for leveling the upper plate. Tightening of all of the hold-down bolts provides an overall decrease in the vertical compliance of the upper plate. The nut engaging the hold-down bolt below the lower panel is preferably secured against rotation and the bolt heads are either directly accessible in counter sunk holes formed in the upper plate or accessible by removing plugs secured in the counter sunk holes over the bolt heads. In either form, the hold-down bolt is preferably positively locked to the upper plate with a second locking nut that bears on the lower face of the upper plate.

Also in the preferred form, a set of control tabs are secured along the opposite edges of adjacent upper plates. The tabs are preferably rectangles of sheet metal secured to the lower face of the upper plates. In operation, the tabs extend horizontally under the lower face of the opposite upper plate. At least one tab is secured to each of the plates. The control tabs limit the maximum relative vertical displacement adjacent plates. To facilitate assembly of the modules to form the playing surface, certain of the control tabs can be pivotally mounted.

These and other features and objects of the invention are discussed in greater detail below with reference to the accompanying drawings.

DETAILED DESCRIPTION OF THE PREFERRED EMBODIMENTS

Recent work by applicants on the biomechanics of locomotion has led to the discovery that there is an optimal or "tuned" degree of "springiness" or vertical compliance which should be present at the interface between a person's foot and the surface on which he is walking or running. This discovery, which is discussed in more detail in applicants' article, "Fast Running Tracks", appearing at pages 148–163 of the December, 1978 issue of *Scientific American,* contradicted the then conventional wisdom that a harder surface will produce a faster running time. In competitive running events, a principal advantage of a tuned surface is an increase in running speed. However, other important advantages are a reduction in the number of injuries associated with running and a general increase in the comfort of the runner. While the principal focus of this work has been on running, particularly competitive running, compliant surfaces are also highly desirable for low speed running and a wide variety of sports and recreation activities that involve movement over the surface or collisions with the surface (such as tackling in football, jumping in volleyball and basketball, or horse and dog racing).

The optimal value of the vertical compliance of a running surface will vary depending on factors such as the weight of the athlete performing on the surface, the type of activity (competitive running, jogging, tennis, basketball, football, multi-purpose), and shoe size. For example, it has been found that for a male runner of average size engaged in competitive sprint running, the surface should have a vertical compliance, expressed as its inverse, a spring constant, of approximately 20,000 pounds of force per foot (lbf/ft). However, for low speed running, for example, jogging at approximately 70% of competitive sprinting speeds, the optimal compliance of the surface is significantly lower. For the example given above, it would be approximately 10,000 lbf/ft. In general, the optimal compliance is inversely proportional to the square of the running speed.

Figure 11:
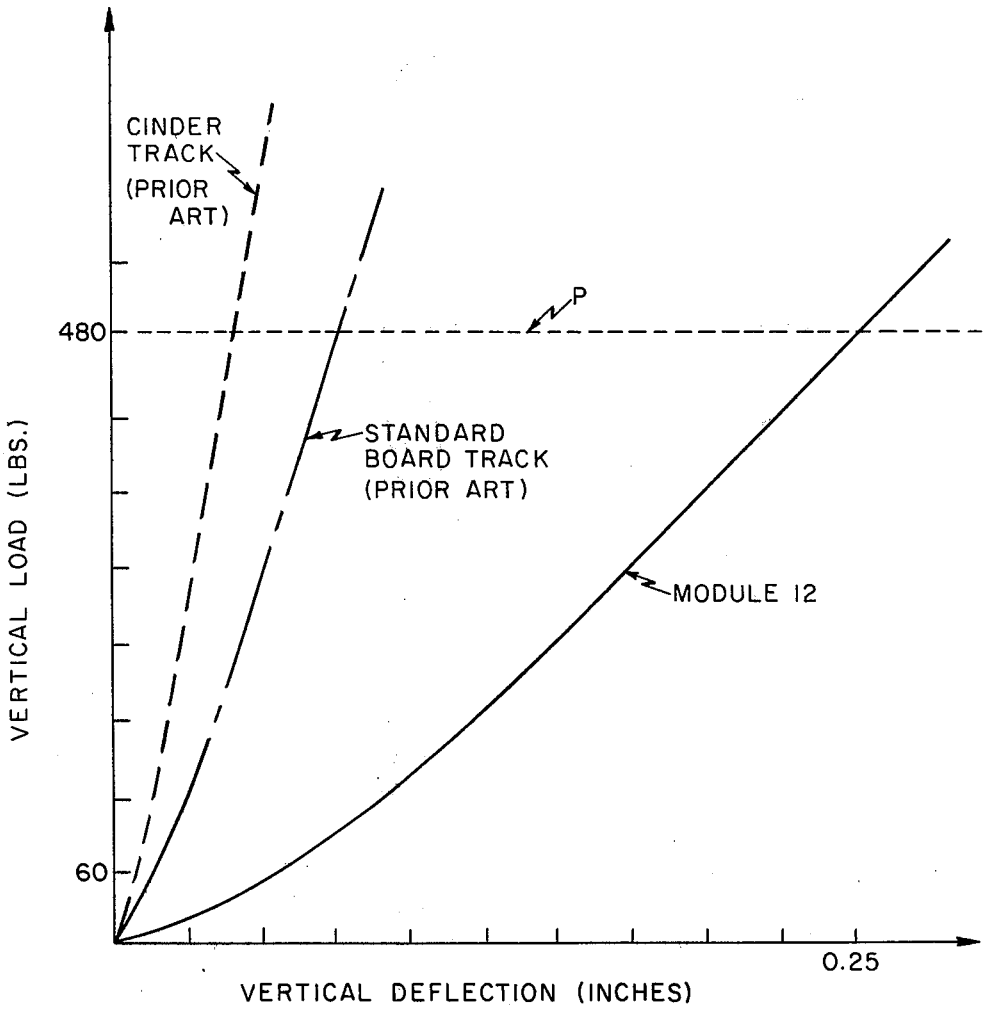
FIG. 11 is a graph showing the deflection of prior art running surfaces and one according to this invention as a function of applied force over a constant unit area.

As a result, it is an important aspect of this invention to provide an athletic playing surface construction which presents what has heretofore been considered an extremely large vertical compliance to a foot impacting on its upper surface. FIG. 11 graphically illustrates the load deflection characteristic of the present athletic playing surface, when adapted for competitive running, as compared to several prior art running surfaces. The abscissa represents the vertical deflection of the surface in inches; the ordinate represents the applied vertical force in pounds of force. As is readily seen, the load deflection curves for two conventional running tracks, one formed of cinders and the other a standard hardwood board track, are significantly steeper than the curve for a highly compliant surface. At a typical peak vertical force while running, indicated by line P, the deflection of the tuned surface is more than three times that of the prior art running tracks.

This large vertical compliance, contrary to previously accepted understanding, is well "tuned" to receive, store momentarily, and return to the runner his energy in a highly efficient manner. A desirable value for this efficiency is 95%. A playing surface according to this invention is also "tuned" to minimize the time a runner's foot has contact with the surface. Because of this minimization of this foot contact time, the relatively large vertical compliance characteristic of this invention has the surprising result of increasing the speed of a runner. In competitive high speed running this invention has been found to increase running speed by 2 to 3% of the peak value attained on hard surfaces with idential surface-traction characteristics. This is equivalent to a 5–8 second increase for a 4 minute miler. A more general discussion of the interaction between a runner and a running surface is found in applicants' article "Harvard Bio-Mechanics Laboratory Report No. 78-1".

In general, it has been found that the advantages of this invention are optimized, for fast running, when the compliance is in the range of 2.0 to 3.0 times the effective spring constant of the runner. (A discussion of the concept of a runner spring constant and associated calculations are found in "Elastic Bounce of the Body" by Cavagna in *Journal of Applied Physiology*, Vol. 29, No. 3, 1970, pp. 279–282.) If the compliance is expressed as its inverse, a spring constant, a range of values which has been found to yield the advantages of this invention are 5,000–35,000 lbf/ft. For high speed, competition running, an optimal compliance is in the range of 20,000 to 25,000 lbf/ft. At compliances below 5,000 lbf/ft., the surface becomes excessively bouncy and interferes with an efficient energy transfer between the runner and the surface. At the other extreme, where the compliance exceeds 35,000 lbf/ft., the surface is sufficiently rigid that injuries commonly associated with running such as shin splints, and knee and ankle injuries tend to occur with significantly greater frequency. Expressed still another way, it has been found that for high speed running, the optimal running surface should deflect vertically approximately $\frac{1}{4}$ inch when an athlete of average weight (160 lbs.) is running at full speed. For slower speed long distance running, the ideal surface should deflect $\frac{3}{8}$ to $\frac{1}{2}$ inch.

While a comparitively large vertical compliance is most important to the practice of the present invention, it is also important that the surface exhibit an extremely high resistance to horizontal compliance or lateral shear in response to a horizontal applied force or a horizontal component of an applied force. As noted above, lateral shear results in a loss of the runner's kinetic energy used to deform the track laterally. The reduction or elimination of lateral shear is particularly important where the athlete is accelerating rapidly or where he is turning while running and leaning in the direction of his turn ("heeled over"). The absence of lateral shear is also important where the surface itself is inclined, as for example where the turn of a running track is banked.

Another important aspect of the athletic playing surface according to this invention is that it exhibits a high degree of uniformity of response over the surface and is substantially free of cross-talk. The invention is also characterized by a comparitively low effective vertical mass, that is, the apparent mass of the surface presented to an athlete's foot when it strikes the surface as opposed to its actual mass if measured on a scale. More specifically, it has been found that for the best results during running, the surface should have an effective vertical mass that is approximately 1/10, or less, of the mass of the person (or animal) running on it. This low effective vertical mass reduces the magnitude of the force spike when a runner's foot lands on the module. It also reduces the rebound time and makes running generally more comfortable.

Figure 1:
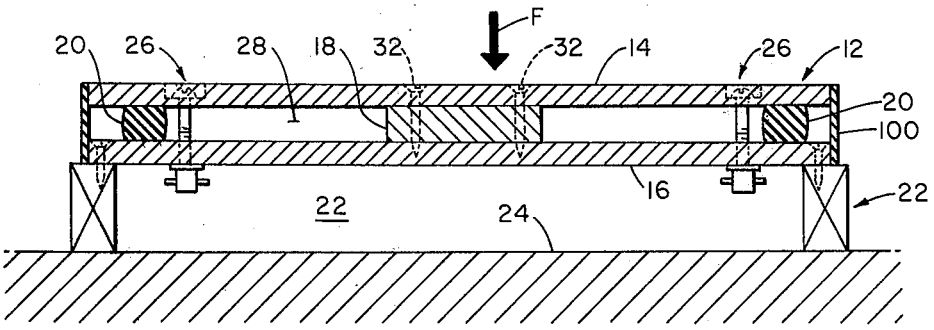
FIG. 1 is a simplified view in vertical section of an athletic playing surface module constructed according to the present invention.
Figure 2:
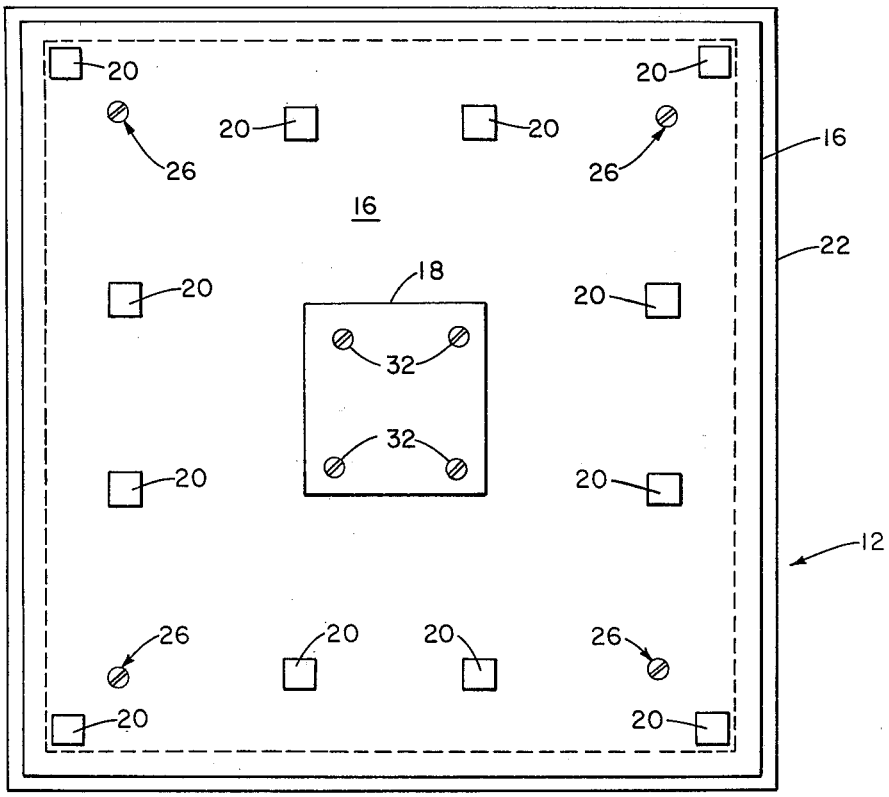
FIG. 2 is a top plan view of the module shown in FIG. 1 with its upper plate removed.

FIGS. 1 and 2 show, in a simplified form, a module 12 constructed according to the present invention which, when placed in a closely spaced side-by-side relationship with like modules, forms an extended athletic playing surface having all of the aforementioned characteristics. The module 12 includes an upper plate 14, a lower plate 16, and a smaller, intermediate spacer plate 18. The module 12 therefore has a "sandwich" type construction. A number of small resilient members 20 are held between the plates 14 and 16 in a generally symmetrical array about the central spacer plate 18. The module 12 is supported at the periphery of the lower plate on a frame 22 which has a configuration conforming to that of the lower plate 16. Screws 32 preferably secure the plate 16 to the frame, but nails or other conventional fasteners are acceptable. The frame 22 in turn rests on a rigid substrate 24 such as a concrete floor or a bed of crushed gravel. The module also includes a set of hold-down or tensioning bolt assemblies 26 shown in detail in FIGS. 3 and 4.

The upper and lower plates 14 and 16 are formed of a stiffly resilient sheet material such as plywood, fiberglass encased plywood, fiberglass, reinforced foamed plastics, sheet metal or any equivalent structural material exhibiting good strength, resilience and fatigue resistance under cyclic loading. The high resilience of these plates promotes an efficient return of energy to an athlete performing on the module 12. In the embodiments shown in FIGS. 1 and 2, the plates 14 and 16 have a generally square configuration and are substantially the same size. Typical materials for indoor applications would be 3 foot or 4 foot square sheets of $\frac{5}{8}$ or $\frac{3}{4}$ inch plywood, or $\frac{1}{2}$ inch thick fiberglass coated plywood. For outdoor use, the plates are preferably formed of a plastic or resinous material or plywood encased in such a material to protect the plates against adverse climatic conditions. To minimize the effective mass of the module 12, the plates 14 and 16 are preferably as thin and light as possible consistent with other requirements placed on them. Applicants have found that the vibration frequency of a plate when loaded with weight of mass $m_2$ is a convenient method for measuring the effective vertical mass $m_1$ of a plate or an athletic surface generally. The weights $m_2$ are loaded on a five inch diameter disk that simulates a foot. The weights are then struck with an impulse force such as the blow of a hammer. The observed vibration frequency f is equal to the square root of $K/(m_1+m_2)$, where K is the local spring constant of the plate or surface.

While the plates are shown as being substantially square, they can be rectangular or have a variety of other configurations depending usually on the surface being constructed and the configuration of the sheet material as purchased. Also, the dimensions of the plates 14 and 16 can vary widely. For example, plates that are 3 feet square may be desirable in the construction of running tracks where a typical running lane has a width of 3 feet, but larger modules may be desired in other applications where cost considerations may favor the installation of fewer modules to cover a given surface area. In any event, it is important to note that a portion of the vertical compliance of the module 12 is derived from a bending or downward flexure of the plates 14 and 16 in response to a downward force F applied to the plate 14 as shown in FIG. 1. For example, F may be the vertical component of the impact force of a runner's foot striking the top surface of the upper plate 14.

The spacer plate 18 is a section of sheet material which is sandwiched between the plates 14 and 16 in a face-abutting relationship. Two principal functions of the spacer plate are (1) to compensate for a non-uniformity in the flexural response of the lower plate 16 due to the constraint of the supporting frame 22 and (2) to mechanically couple the plates in a manner that provides an enormous resistance to lateral shear. The spacer plate 18 can be formed of the same sheet material as the plates 14 and 16 or any other suitable structural material. Preferably the flexural properties of the plate 18 are roughly comparable to those of the plates 14 and 16 so that it transmits the applied forces evenly. The thickness of the spacer plate 18 determines, to a large extent, the vertical spacing between the plates 14 and 16. The plates 14 and 16 are generally parallel and the gap 28 between them therefore has a generally uniform height.

Screws 32 secure the spacer plate 18 to both the upper plate 14 and the lower plate 16 to mechanically couple them to one another. Many other conventional fastening arrangements are also acceptable including bolts, nails, staples, or glueing. While each of the screws 32 is shown as penetrating each of the plates 14, 16, and 18, one set of screws can couple the upper plate to the spacer plate and a second set of screws can couple the lower plate 16 to the spacer plate. This arrangement facilitates removal or replacement of the upper plate 14 by removing only the first set of screws, leaving the spacer plate secured to the lower plate 16 by the second set of screws.

The resilient members 20, as best seen in FIG. 2, are positioned in a generally symmetric array with respect to the spacer plate and the plates 14 and 16. The members 20 are also positioned at points removed from the spacer plate and, in general, near the edges of the plates 14 and 16. The principal function of the members 20 is to support the plate 14 in a manner which provides a substantially uniform vertical compliance for this plate over its entire upper face. (For example, if there were no rubber resilient members positioned in the gap 28, the vertical compliance of the module 12 near its edges would be much greater than at its center due to the spring action of the upper plate.) The resilient members are preferably secured only to the lower plate 16 to facilitate the removal or replacement of the upper plate 14. They may be secured by conventional adhesives, stapling or any equivalent arrangement.

The members 20 are highly resilient (i.e. exhibit minimal internal damping) to provide an efficient return of energy to the runner. They are also resistent to creep, that is, they maintain their shape under the constant loading of the upper plate 14 and impacts of athletes performing on the module. To provide a practical commercial surface, the members 20 should also exhibit minimal changes in their mechanical properties with changes in temperature and humidity and they should be stable enough to maintain their original specified properties for 10 to 15 years. These last two characteristics are particularly important in the construction of outdoor playing surfaces. Silicone rubber has been found to meet all of these requirements, but other less expensive materials such as neoprene can also be used with some reduction in performance. An acceptable silicone rubber is grade 300–700 "Cohrlastic" sold by the Connecticut Hard Rubber Co. If neoprene is used, it should preferably have a durometer value in the range of 15 to 80. The rubber cushions should extend vertically at least the height of the gap 28. The gap 28, in turn, should be sufficiently large that under a peak applied load the members 20 compress to roughly half of their initial, no-load height. A gap height of approximately ¾ inch has been found to be acceptable for most running surfaces. A narrower gap may require additional members 20 or members 20 with larger, more complex face areas. For most applications, the resilient members are small squares.

The vertical compliance (load deflection response) of the module 14 is a function of many parameters. As noted above, the constituent material, dimensions and configurations of the plates 14 and 16 are one set of factors. These factors, however, are often set by the nature of the surface being constructed and standard sizes of the plate material. The load deflection response of the module is therefore usually "tuned" to a desired value through a selection of the size, configuration and location of the spacer plate and the resilient members. The response will also depend on the number of resilient members used, their constituent material, the constituent material of the spacer place, and the manner in which the plate 16 is supported on the frame 22. If the plate is clamped at its periphery so that it is constrained from bending, the apparent or effective vertical mass of the plate is roughly half that of the plate when it is simply supported on the frame (it rests on the frame, but its periphery is not otherwise constrained).

Some general design considerations are as follows. First, the spacer plate should be located at the point of maximum compliance of the lower plate 16. For a square plate with a square support frame 22, the spacer plate should be substantially centered on the plate 16. Second, the spacer plate should have a configuration which is generally similar to that of the plate 16. For example, a square spacer plate used in conjunction with a square plate 16 produces a generally uniform change in the flexural response of the module. In contrast, a long, thin, rectangular spacer would produce an increased and non-uniform stiffness along its longitudinal axis. Third, the spacer plate should be sufficiently small that it does not prevent the desired flexure of either the plate 14 or the plate 16. On the other hand, it should be sufficiently large to couple mechanically the upper and lower plates and thereby stiffen the load deflection response of the module in the region of the spacer plate. The amount of stiffening should compensate for the non-uniform effect of the support frame 22. The precise dimensions and configuration of the spacer plate will of course vary depending on factors such as the requirements of a specific surface, the plates 14 and 16 and the desired degree of compliance.

The resilient members are positioned to complement the compliance of plates 14 and 16 as constrained by the frame 22 and the spacer plate 18 to provide a substantially uniform vertical compliance over the plate 14 regardless of where an athlete may land on it. Since the plate 14 is otherwise unsupported at points remote from the spacer plate, one general design principle is that the resilient member should be positioned at such "remote" points. For a centrally located spacer plate, the members 20 should be positioned at least near the periphery of the plate 14. Another design principle is that the resilient members are placed in a generally symmetrical pattern with respect to the plates 14, 16, and 18 to achieve a uniform response over the top plate 14. As with the spacer plate 18, the exact dimensions and placement of the resilient members will vary depending on the optimal compliance desired and variations in the other parameters discussed hereinabove. It should be noted that in addition to varying the location, number or face area of the members 20, it is also possible to vary their durometer.

By way of illustration but not of limitation, the module 12 shown in FIGS. 1 and 2 can be formed of plates ¾ inch plywood that are four feet square with a centrally located spacer plate, also of ¾ inch plywood, that is one foot square. The resilient members can be ¾ inch thick, 2 inch by 2 inch squares of 15 durometer neoprene with four of the resilient members located near the four corners of the plates and eight other resilient members spaced generally equiangularly around the spacer plate, but set back farther from the edges of the plates than the four corner members.

Figure 12:
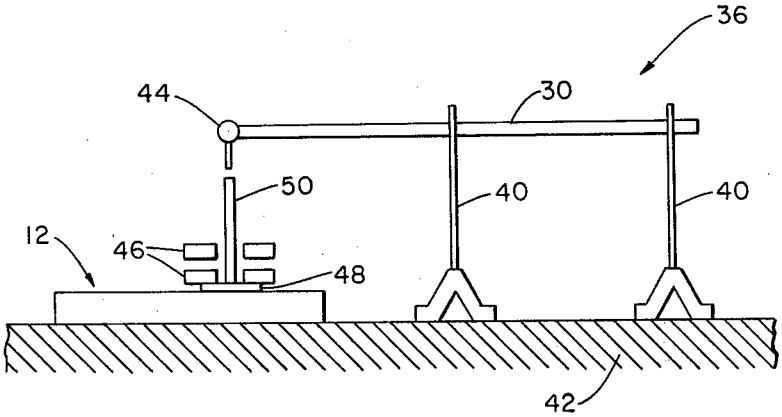
FIG. 12 is a simplified view in side elevation of a test apparatus for measuring the vertical compliance of a surface.

Applicants have found that extremely high degrees of unformity in the vertical compliance of the plate 14, that is, variations as low as 10 to 15%, can be achieved through relatively straightforward trial and error adjustments in the size of the spacer plate and the placement of the resilient member 20. To measure the vertical compliance, applicants have used a test apparatus 36 (FIG. 12) that includes an aluminum bar 30 with a cross-sectional dimensions of ¼ inch by 2 inch which is held horizontally in a pair of ring stand supports 40, 40 resting on a base 42 corresponding to the substrate 24 in FIGS. 1 and 2. The module to be tested is positioned on the base 42 under an end of the bar 30 which supports an Ames displacement gauge 44 capable of measuring movement to within ±0.001 inch. The deflection load is supplied by removable weights 46 carried on an aluminum shoe 48 having a five inch diameter. The five inch diameter was selected because it is approximately equal to a surface area of an average man's size ten shoe. A rod 50 connects the loaded shoe 48 to the displacement gauge 44 to transmit the displacement of the module induced by the weights to the gauge where it is measured.

The module 12 also includes a set of the hold-down or tensioning bolts assemblies 26, each positioned near one corner of the plates 14 and 16 as shown in FIG. 1. The hold-down bolt assemblies are shown in more detail in FIGS. 3 and 4. A bolt 56 freely penetrates a pair of aligned holes **14*x* and 16*x* drilled in the upper and lower plates, respectively. The upper plate also includes a counter-sunk recess 14*y* to accommodate the head 56*a* of the bolt. A washer 58 is engaged between the head of the bolt 56 and the recess 14*y*. A stop nut 60 carried in a slotted flange element 62 threads onto the bolt 56 and bears against the lower surface of the lower plate 16 through a washer 64. The stop nut has an insert which is preferably formed of an elastic material to make the nut self-tightening on the bolt in the manner of conventional aircraft locking nuts. The gripping action of the "elastic" nut prevents the bolt or nut from loosening during use. The stop nut 60 also includes a pair of laterally extending pins 66, 66 which engage the flange member 62 in a pair of downwardly open, vertical slots 62*a*, 62*a*. This pin and slot arrangement prevents rotation of the stop nut in conjunction with the rotation of the hold-down bolt. This allows the convenient removal or adjustment of the bolt 56 at the upper surface of the module with an ordinary socket wrench or screwdriver than engages the bolt head 56*a***.

While the hold-down bolt assemblies 26 provide some degree of mechanical coupling between the plates 14 and 16, their principal function is to limit the maximum vertical spacing between the plates. This limitation controls intra-module crosstalk. For example, when a runner lands on one corner of the upper plate 14, the plate acts like a lever about the central spacer plate 18 resulting in some upward movement, or a transmitted upwardly directed force, at the diametrically opposite corner. The hold-down bolt assembly 26 prevents such an upward movement and to some extent counteracts this force. Another function of the hold-down bolts is to allow an adjustment in the level of the plate 14 or in the overall vertical compliance of the module. With respect to the latter adjustment, if all of the bolts are tightened to draw the plates 14 and 16 toward one another, the plates themselves as well as the resilient members 20 are prestressed. As a result, the module 12 exhibits a generally uniform increase in stiffness (less vertical compliance). The hold-down bolt assemblies thus provide a convenient method for fine tuning the compliance of the athletic playing surface to accommodate for the variations in compliance due to atmospheric changes such as temperature or humidity, aging, or to accommodate different uses of the surface. The modular "sandwich" construction of the present invention also lends itself to a replacement of the entire upper plate 14. Removal of the bolts 56 and the screws 30 frees the top plate (provided that the resilient members are secured only to the lower plate 16). This allows the performance characteristics of the surface to be changed through a replacement of the plate 14 as well as the the replacement of worn, damaged, or defective upper plates without any substantial dismantling of the surface.

It should also be noted that this invention lends itself to retro-fitting or up-grading the performance of many existing conventional surfaces. The existing surface forms the lower plate 16. Given its resilience, effective vertical mass, underlying support, and resilience characteristics, appropriate spacer plates, upper plates, resilient members and hold-down bolt assemblies are selected and secured over the existing surface.

Figure 3:
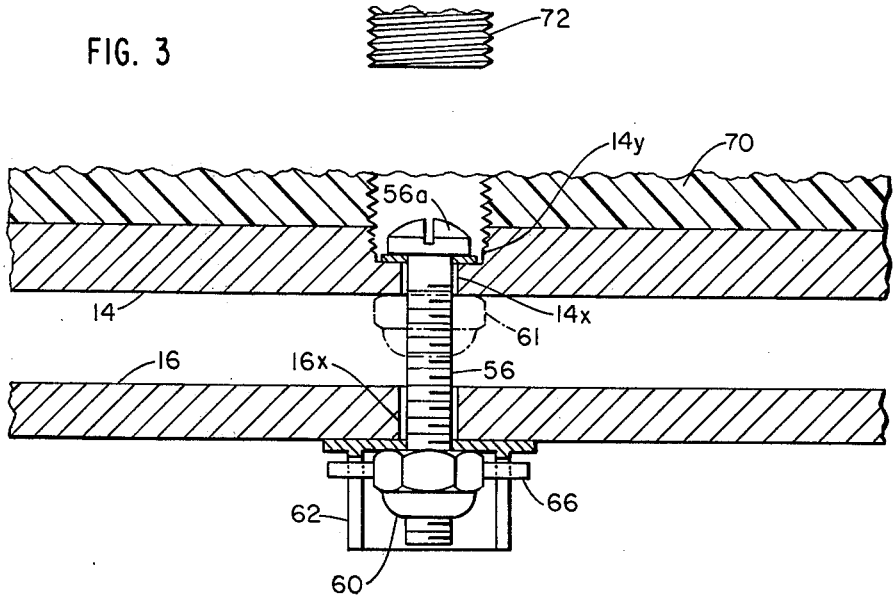
FIG. 3 is a detailed view in vertical section and partially in side elevation of a hold-down bolt assembly used in the module shown in FIGS. 1 and 2 but including a thin upper layer of a synthetic plastic material.
Figure 3:
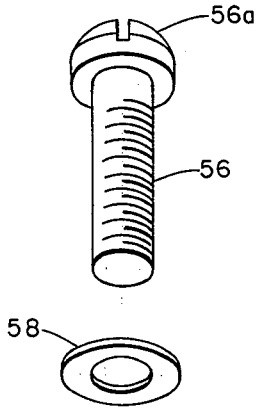

FIG. 3 also illustrates that the invention can be used in conjunction with a thin top layer 70 of a synthetic plastic material such as polyurethane. The layer 70 can be applied over the modules 12 in any well known manner. The layer 70 may be useful, as in prior art designs, for enhanced traction, decreased maintanence, or an improved appearance of the surface. To apply a continuous top layer 70, strips of a flexible material are adhered across the gaps between the adjacent upper plates of the modules forming the athletic playing surface. The counter-sunk recesses **14*y* in the upper plate at the bolt heads can be blocked off and later filled with a replaceable plug 72 which may be threaded to engage the surrounding polyurethane layer. The layer 70 can also be applied to the modules 12** independently with the spacing or gap between the modules remaining open. This construction can be particularly useful in outdoor applications where on-site drainage is required.

Figure 6:
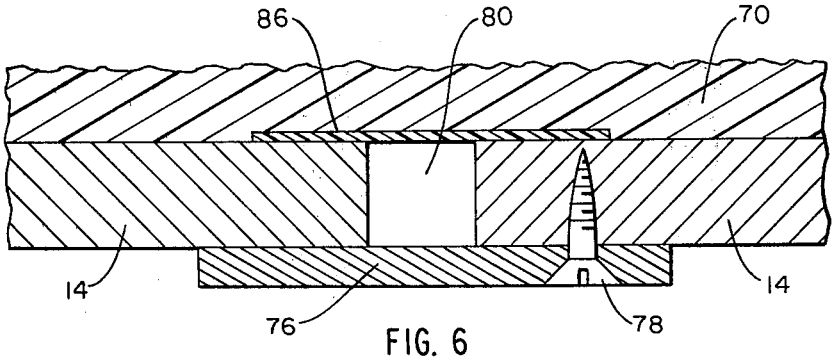
FIG. 6 is a detailed view in vertical section of one of the control tabs shown in FIG. 5 and also showing a thin top layer of a synthetic plastic material covering the modules.
Figure 5:
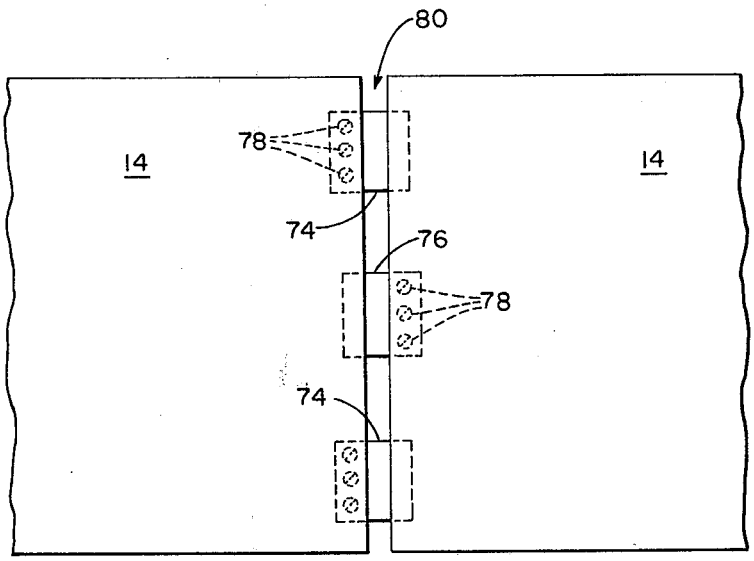
FIG. 5 is a top plan view showing a set of control tabs according to this invention which span the gap between two adjacent modules of the type shown in FIGS. 1 and 2.

FIGS. 5 and 6 show control tabs 74 and 76 which are secured by screws 78 to the lower faces of the upper plates 14 of adjacent modules of the type shown in FIGS. 1 and 2. A first set of control tabs 74, 74 is secured to the left hand plate 14 as shown in FIG. 5. Each of the control tabs 74 extends across a gap 80 between adjacent plates, typically having a width of approximately ⅛ inch, and under the adjacent upper plate 14. A second set of control tabs, represented by a single control tab 76 in FIG. 5, is secured to the right hand upper plate 14 as shown in FIG. 5. The control tab 76 also spans the gap 80 and extends for a short distance under the opposite upper plate 14. The tabs 74 and 76 are each formed of a flat metallic sheet preferably with a generally rectangular configuration as shown. A suitable metal is aluminum.

Figure 9:
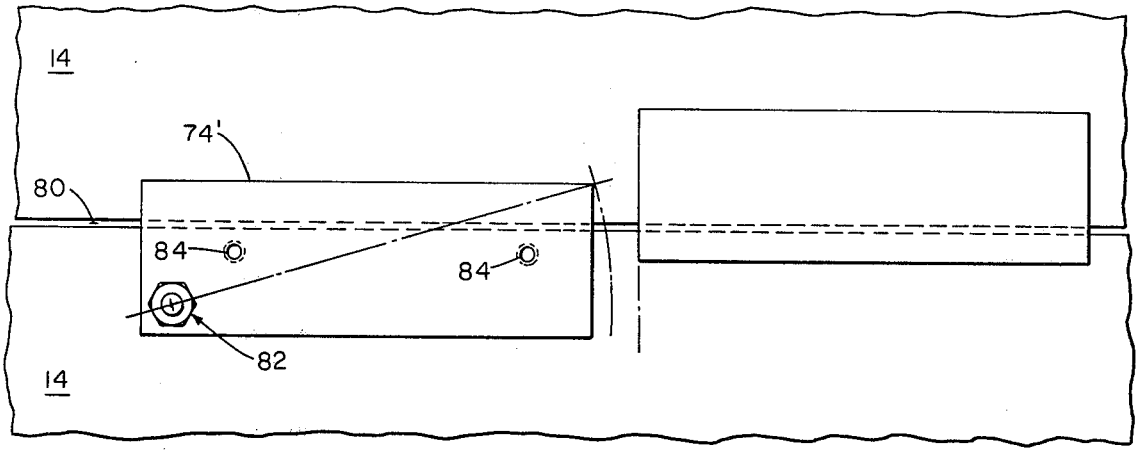
FIG. 9 is a detailed view of a pivotable control tab according to the present invention.
Figure 10:
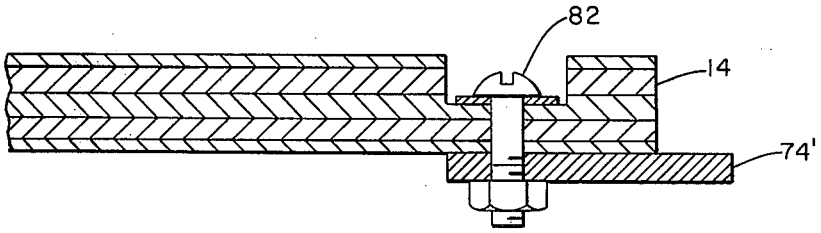
FIG. 10 is a detailed view in vertical section of the pivoting arrangement shown in FIG. 9.

It is frequently desirable to be able to remove one or several modules from the surface without totally dismantling the surface. The presence of fixed position control tabs secured by screws 78 as shown in FIGS. 5 and 6 prevents the removal of an upper plate 14 by simply lifting it from the module once the hold-down bolts and screws 30 are removed. To solve this problem, all or some of the modules forming the athletic playing surface use control tabs 74' that are mounted on a pivot bolt 82 (FIGS. 9 and 10) which penetrates the upper plate 14 and threads into a hole formed in the control tab. The pivot point on the control tab is located so that the tab can be pivoted to a position where it is substantially clear of the adjacent upper plate for insertion and removal and then rotated into a position where one edge of the control tab extends under the adjacent module as shown in FIG. 5, 6, or 9. The control tab 74' can be formed of 3/16 inch thick aluminum with dimensions of 2 inches×6 inches. The pivot point is set approximately ½ inch from the edges of the tab at one corner. When the control tab is pivoted to its engaging or operational position, it projects for approximately ½ inch beyond the end of the upper plate to which it is secured. Since the gap 80 between the adjoining plates is typically on the order of ⅛ inch or less, a significant portion of the control tab extends under the adjacent upper plate. In its operational position, the tab 74' is secured by set screws which engage the tab in threaded holes 84, 84. Adjacent tabs 74' are mutually spaced to allow a clearance for the tabs through the pivoting motion. The pivot bolt 84 is secured by an elastic locking nut which resists loosening during use.

The control tab systems of this invention prevent a vertical mismatch between the edges of adjacent upper plates 14 while at the same time minimizing the mechanical coupling between these plates which would tend to increase the effective vertical mass of the surface and cross-talk between modules. It is significant to note that this control system eliminates tension and bending coupling between the plates. It is also significant that because the plates extend in both directions across a given gap 80, the edges of the plates will maintain a generally aligned relationship regardless of the direction of movement of the athlete's over the modules. For example, with reference to FIG. 5, if a runner is traveling from right to left and lands at the left edge of the righthand module, a downward deflection of this edge will cause the plate 14 to engage the tabs 74, 74 which will in turn cause a corresponding downward deflection of the adjacent edge of the lefthand module 14. Conversely, if a runner is traveling from left to right and lands on the right edge of the lefthand module, a downward deflection of this edge causes the associated plate 14 to engage the tab 76 which in turn causes a corresponding downward deflection of the edge of the righthand upper plate 14. This control of the edge alignment is important to prevent an irregularity in the surface which could trip an athlete performing on the surface. If the surface is covered by a thin polyurethane layer 70, as shown in FIG. 6, this system also minimizes the shear forces applied to the layer 70 in a region over the gap 80 to extend the useful life of the surface 70. FIG. 6 also illustrates a flexible cloth tape 86 spanning the gap 80 which allows the polyurethane layer 70 to be poured over the modules 12.

Figure 7:
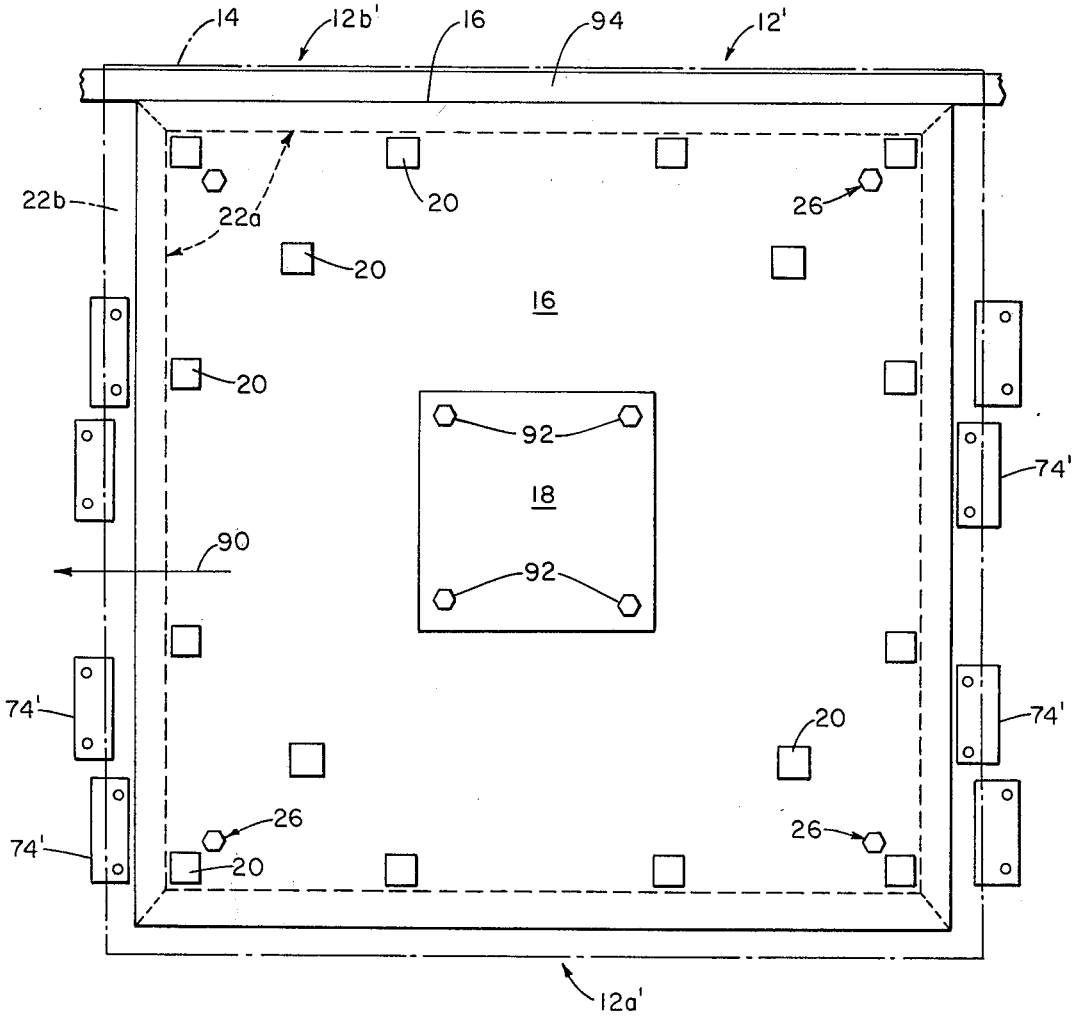
FIG. 7 is a top plan view with the upper plate shown in phantom of another embodiment of a module suitable for forming a playing surface according to the present invention together with portions of two adjoining modules.

FIG. 7 shows a generally square module 12' (like numbers in the various figures designating like elements) particularly adapted for use in a flat or straightaway section of a running track. The upper plate is removed but its dimensions are indicated by a dotted line 14 defining the outermost periphery of the module 12'. The frame 22 is formed by four pairs of 2×4 inch wooden rails with each pair of rails in a face abutting relationship and resting on their narrow sides. The inner four rails define a frame portion **22*a* that supports the lower plate 16. The frame 22*a* is generally flush with the outer edge of the lower plate 16. The outer four rails define a frame portion 22*b* that is generally coincident with the overhang of the plate 14 with respect to the plate 16. The outer frame members 22*b* are slightly taller than the inner frame members 22*a*. This increased height provides a stop or "bottoming out" mechanism to limit the maximum downward movement of the upper plate 14** at its periphery.

By way of illustration but not of limitation, the bottom plate is preferably a sheet of fiberglass encased plywood having a thickness of ½ inch, a length of 45 inches in the running direction (indicated by an arrow 90) and a width of 45 and ½ inches. The upper plate 16 is a sheet of ⅝ inch ACX grade plywood. The spacer member 18 is a sheet of ¾ inch plywood that is 10 inches square and centered on the plates 14 and 16. The spacer is secured to the plates 14 and 16 by bolts 92. The resilient members 20 are sixteen neoprene pads having a thickness of ¾ inch and faces that are 2 inches square. Twelve of the pads are placed near the outer edge of the lower plate 16 and set back from the edge by the width of the support frame **22*a* four pads are positioned at the corners of the plates and the other eight pads are evenly spaced between the corner pads. The four remaining pads are each set with their edges approximately eight inches from the outer corner edges of the lower plate measured on a perpendicular to the edge. Four hold-down bolt assemblies 26 are also positioned near each of the corners, set back approximately 6 inches from the corner edges of the upper plate 14, again measured on a perpendicular from the edges. Two control tabs 74' are secured to the edges of the panel that are adjacent other modules 12'. In the embodiment shown, the lower edge 12*a*' of the module defines the inner perimeter of the running track and therefore does not mate with another module 12'. The upper edge 12*b*' mates with a portion of the track which does not have the vertical compliance characteristics of the present invention and therefore its movement is restrained by a strip spacer 94 which engages the lower face of the upper plate 14 along its edge. The module 12'** constructed as described above provides all of the advantages of the present invention and is tuned to provide an optimal vertical compliance for competitive high speed running of approximately 20,000 lbf/ft.

Figure 8:
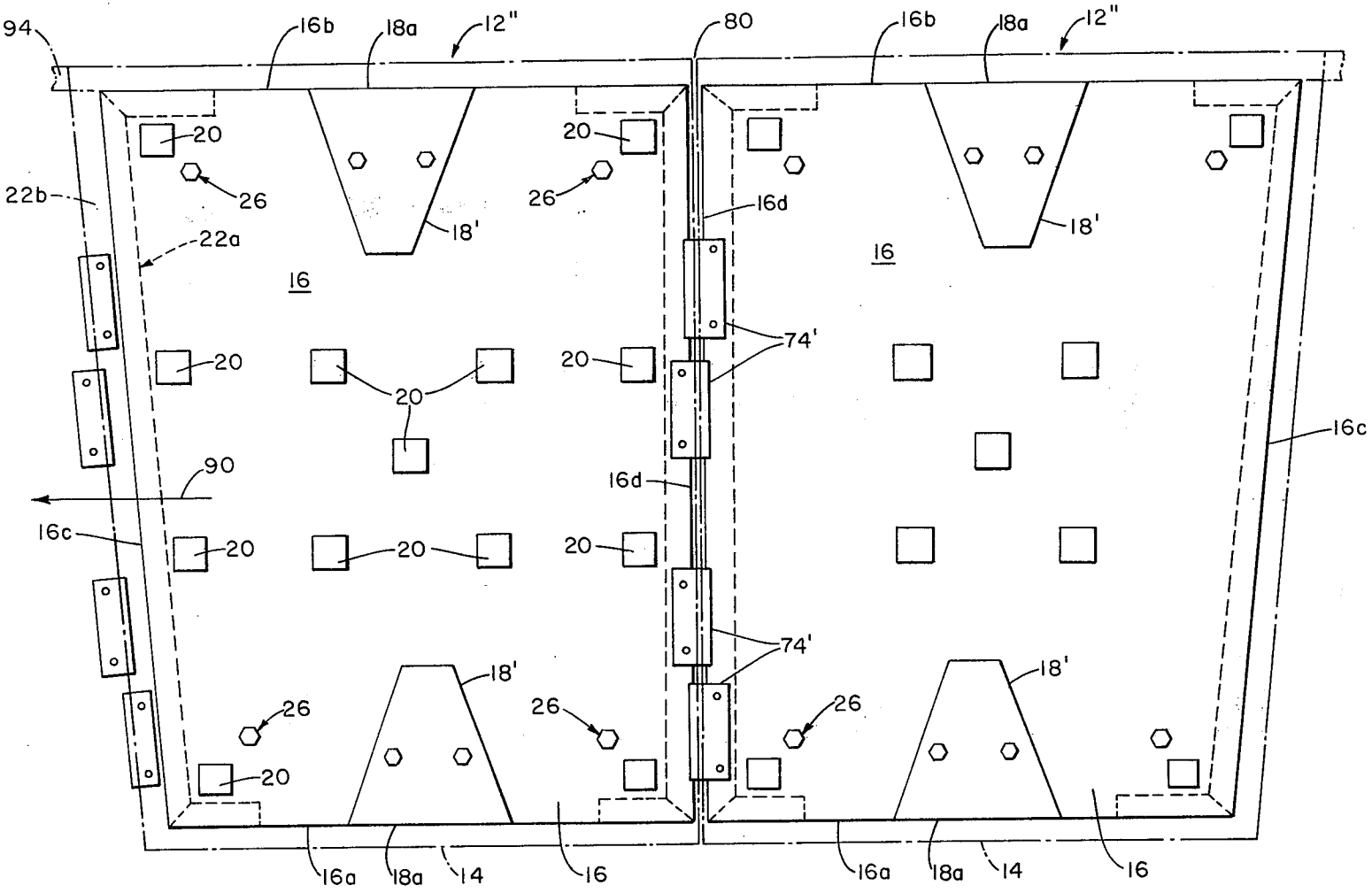
FIG. 8 is a top plan view with the upper plate shown in phantom of modules utilizing yet another embodiment of the invention useful in the construction of banked turns for running tracks.

FIG. 8 shows a pair of adjoining modules 12'' each adapted to form an inclined or banked turn portion of a running track that utilizes the module 12' for its straightaway portions. The materials and general construction of the modules 12'' are the same as the modules 12' except that the modules 12'' are more rectangular in configuration. Again by way of illustration but not of limitation, the lower plates of the modules 12'' have a width (measured transverse to the running direction) of 45 and ½ inches, the same as that of the plate 16 of the module 12'. The inner edge **16*a* extends for 32 and ¼ inches and the outer edge extends for 36 and ⅛ inches. To accommodate these differences in the lengths of the plate 16 in the running direction, one transverse edge 16*c*** is trimmed or inclined along a substantially straight line. The degree of the trim depends on the turn radius and the banking angle of a given track. The dimensions specified are suitable for a track having a turn radius of approximately 36 feet and a bank angle of approximately 20°.

The support frame 22 for the modules 12'', like the support frame for the modules 12', is formed by inner and outer face abutting, pairs of 2×4 inch wooden rails. The outer four rails 22b are approximately $\frac{5}{8}$ inch taller than the inner four rails 22a which are flush with and support the edges of the lower plate 16. A significant difference in the module 12'', however, is that the lower plate is supported continuously only along its transverse edges 16c and 16d. Along the shorter sides 16a and 16b the inner frame members 22a extend toward one another from the corners for approximately 5 inches resulting in a support of facing "C" shaped frames. The edges 16a and 16b of the lower panels are therefore unsupported over a significant portion of their length. To compensate for this lack of support, and to provide a uniformity in the compliance of the module over its entire surface, two spacer plates 18' are used for each panel rather than a single spacer plate 18 as shown in FIGS. 1, 2, and 7. The spacer plates 18' are generally trapezoidal in shape with their bases 18a generally aligned with the unsupported edge of the lower plate 16 and centered on its midpoint. For the materials and dimensions specified above, the spacer plates 18' preferably have a height of approximately 10 inches, a base length of approximately 10 inches and a upper edge length of approximately 3 inches. The spacer plates 18' are formed of $\frac{3}{4}$ inch plywood.

The resilient rubber members 20 used in modules 12'' are again 2 inches square by $\frac{3}{4}$ inch thick neoprene pads preferably secured to the lower plate 16 by a suitable adhesive. To compensate for the lack of a spacer member in the center of the plates 14 and 16, one resilient member is centered on the plates with four other members equiangularly spaced around it and set back 16 inches from the edge 16b and 11 inches from the edge 16d. Four other resilient members are positioned near the corners of the plates, set back approximately 2 inches from the corner edges of the lower plate 16 (measured along a perpendicular) with two other resilient members being equally spaced along the edges 16c and 16d. The hold-down bolt assemblies 26 are each set back approximately 6 inches from the outer corner edges of the upper plate 14 (measured along a perpendicular to the edge).

FIG. 8 illustrates the design flexibility of the invention. The nature of the surface required that the module be formed of trimmed rectangular (trapezoidal) plates. It was found that with a continuous peripheral support of the lower plate and a central spacer member, the module 12'' exhbited an unacceptably high level of stiffness. Therefore the support frame was eliminated along the shorter sides and the spacer plates were positioned, configured, and dimensioned to accomodate for this change in the underlying support. Similarly, the positioning and number of resilient members, in combination with the effect of the frame, plate configuration, and spacer plates provided a substantially uniform and optimal degree of compliance over the upper plate 14 of the module 12''. It should also be noted that the modules 12'' include control tabs 74' positioned to mate with adjoining control tabs on other modules 12'' or 12'. As with the module 12', the inner edge of the module does not have control tabs since it defines the inner edge of the running surface and the outer edge of the modules mates with a surface which is significantly less resilient and therefore movement of the outer edge is restricted by a spacer strip 94.

Figure 4:
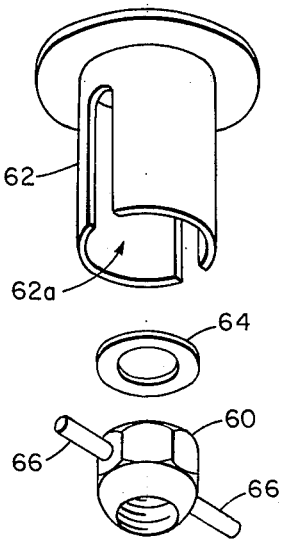
FIG. 4 is an exploded perspective view of the hold-down bolt assembly shown in FIG. 3.

The hold-down bolt assemblies 26 for the modules 12' and 12'' are somewhat different than the assemblies 26 as shown in FIGS. 3 and 4. A principal difference is that they do not employ the slotted flange 62 or pins 66, 66 on the nut. Rather, the bolt utilizes straightforward aircraft-type elastic locking nut which are half threaded metal and half unthreaded plastic material. The bolt, as it is tightened onto a nut, forms a thread in the plastic material. Once tightened, the nut is firmly locked in position. Suitable washers are provided between the head of the bolt and the upper plate as well as between the nut and the lower face of the bottom plate. The modules 12' and 12'' also preferably include a second aircraft-type locking nut 61 (FIG. 3) threaded on the bolt above the first locking nut and bearing against the lower face of the upper plate 14. This arrangement secures the hold-down bolt to the upper plate and controls noise.

For outdoor use, in addition to forming the plates of a weather resistant material, the entire module can be sealed with a plastic adhesive strip 100 (FIG. 1) which extends between the plates 14 and 16 and seals the interior of the module against dirt, debris, sunlight, and moisture. This arrangement insures that no foreign materials interfere with the operation of the modules components and blocks adverse climatic conditions which could detereorate the resilient members or other components of the modules.

As noted above, the proper degree of vertical compliance of sandwich type modules constructed according to the present invention is achieved through the interaction of the various components principally the plates 14, 16 and 18, the resilient members 20 and the frame 22. Also, it was noted above that a relatively high degree of uniformity of response can be achieved in the application of a few design principles. However, with the present construction it is possible to achieve extremely high degrees of uniformity or compliance at a precisely defined value through computer analysis of various parameters affecting compliance.

There has been described an extended athletic playing surface formed from a closely spaced array of modules, each with a laminated or "sandwiched" construction, which provide a relatively high and optimal degree of vertical compliance while at the same time exhibiting an extreme resistance to lateral shear, a high degree of uniformity of response over the surface of the module and an efficient return of energy to the runner. The large compliance provides speed, comfort, and injury reduction advantages to runners or other athletes performing on the surface. The present invention also offers the advantages of allowing the overall compliance of each module as well as the entire surface to be tuned or adjusted after installation as well as the replacement of the upper plates forming the surface. The invention also provides modules that control intramodule and intermodule cross-talk as well as a possible vertical mismatch of the edges of adjacent modules.

While the invention has been described with reference to its preferred embodiments, it will be understood that other variations are possible. For example, the resilient members 20 can be continuous annular rings or other configurations designed to provide the proper degee of resilient support over the plate 14. Also, while the frame 22 has been described as a generally box-like or opposed "C" frame arrangement formed from wooden rails, the lower plate can be supported at its periphery using other straightforward mechanical arrangements. The lower plate 16 can also be supported at points other than its extreme periphery, but with suitable adjustments in the configuration and location of the spacer plate or plates in the resileint members. Further, while the invention has been described principally with respect to a running track, it should be noted that the properties of the invention are well adapted for use in a wide variety of athletic playing surfaces, both indoor and outdoor. These and other modifications and variations will be apparent to those skilled in the art from the foregoing description of the invention and the accompanying drawings. Such modifications and variations are intended to fall within the scope of the appended claims.

What is claimed and secured by Letters Patent is:

1. An athletic playing surface that receives impacts on its upper surface comprises an array of modules in side by side, closely spaced relationship, each of said modules comprising an upper plate and a lower plate, said plates being stiffly resilient and in a generally parallel, spaced apart relationship, spacer means coupled between said upper and lower plates in a face abutting relationship, the abutting faces of said spacer means having an area that is substantially smaller than that of either of said plates, said spacer means having a flexural stiffness at least roughly comparable to the flexural stiffness of said plates, and a plurality of resilient members disposed between said upper and lower plates, said resilient members being substantially more resilient than said plates and spacer means, and spaced horizontally from and arranged in a pattern substantially circumscribing at least two sides of each said spacer means, said module having a large vertical compliance and presenting a low effective vertical mass to said impacts, and said spacer means and resilient members having their dimensions and their locations with respect to said plates selected to provide a compliance response to said impact that is substantially uniform over said upper plate and substantially independent of the area of the impact.

2. An athletic playing surface according to claim 1 further comprising means for supporting said lower plate to allow a vertical flexing movement of the plate in response to said impacts.

3. An athletic playing surface according to claim 2 wherein said supporting means supports said lower plate along its entire periphery and said spacer means comprises a plate member substantially centered on said upper and lower plates.

4. An athletic playing surface according to claim 2 wherein said plates are generally rectangular, said support means extends generally along two opposed edges of said lower plate and said spacer means comprises a pair of plate members each located adjacent the unsupported edges of said lower plate generally midway between said supported edges.

5. An athletic playing surface according to claim 2 wherein a portion of said frame extends laterally beyond said lower plate and is spaced from said upper plate to limit the maximum downward deflection of said upper plate.

6. An athletic playing surface according to claim 1 wherein said resilient members are formed of a highly resilient material.

7. An athletic playing surface according to claim 6 wherein said highly resilient material has a durometer value in the range of 15 to 80.

8. An athletic playing surface according to claim 1 further comprising means for securing said plates to one another at points removed from said spacer means.

9. An athletic playing surface according to claim 8 wherein said securing means limits the maximum vertical spacing between said plates.

10. An athletic playing surface according to claim 9 wherein said securing means are located at a plurality of generally symmetrical points around the periphery of said module.

11. An athletic playing surface according to claim 9 wherein said securing means comprises a bolt and a nut threaded on the bolt.

12. An athletic playing surface according to claim 11 further comprising means for securing said nut against rotation.

13. An athletic playing surface according to claim 11 wherein said nuts are lock nuts with locking elastic inserts.

14. An athletic playing surface according to claim 1 wherein said plates are plywood.

15. An athletic playing surface according to claim 1 wherein said plates are fiberglass encased plywood panels.

16. An athletic playing surface according to claim 1 wherein said plates are a plastic sheet material.

17. An athletic playing surface according to claim 1 wherein the upper plates of adjacent pairs of said modules are generally co-planar when undeflected and further comprising means for controlling the relative vertical displacement of the adjacent edges of said adjacent upper plates.

18. An athletic playing surface according to claim 17 wherein said control means comprises at least one first control tab secured to one of said adjacent upper plates and extending horizontally under the other adjacent upper plate and at least one second control tab secured to said other adjacent upper plate and extending horizontally under said one adjacent upper plate.

19. An athletic playing surface according to claim 18 wherein said first and second control tabs are secured alternately along said adjacent edges.

20. An athletic playing surface according to claim 18 wherein said control tabs are pivotally secured to said upper plates.

21. An athletic playing surface according to claim 1 wherein said resilient members are secured to said lower plate.

22. An athletic playing surface according to claim 1 wherein said vertical compliance is in the range of 5,000 to 35,000 lbf/ft when expressed as a spring constant and applied over a rigid five inch diameter disk.

23. An athletic playing surface according to claim 1 wherein said effective vertical mass is no greater than 1/10 the mass of an athlete performing on the surface.

24. An athletic playing surface according to claim 1 wherein said uniformity of vertical compliance varies less than $\pm 15\%$ over said upper plate.

25. An athletic playing surface that receives impacts on its upper surface comprises an array of modules in side by side, closely spaced relationship, each of said modules comprising an upper plate and a lower plate, said plates being stiffly resilient and in a generally parallel, spaced apart relationship, spacer means coupled between said upper and lower plates in a face abutting relationship, the abutting faces of said spacer means having an area that is substantially smaller than that of either of said plates, said spacer means having a flexural stiffness at least roughly comparable to the flexural stiffness of said plates, a plurality of resilient members disposed between said upper and lower plates, said resilient members being substantially more resilient than said plates and spacer means, and spaced horizontally from and arranged in a pattern substantially circumscribing at least two sides of each said spacer means, support means for said lower plate to allow a vertical flexing movement of the plate in response to said impacts, means for securing said plates to one another at points removed from said spacer means in a manner that limits the maximum vertical separation between said upper and lower plates, and means for controlling the vertical displacement of the edge of said upper plate relative to the edges of the upper plates of said closely spaced adjacent modules, and said module having a large vertical compliance and presenting a low effective vertical mass to said impacts, and said spacer means and resilient members having their dimensions and their location with respect to said plates selected to provide a compliance response to said impact that is substantially uniform over said upper plate and substantially independent of the area of the impact.

* * * * *

UNITED STATES PATENT AND TRADEMARK OFFICE

CERTIFICATE OF CORRECTION

PATENT NO. : 4,325,546

DATED : April 20, 1982

INVENTOR(S) : Thomas A. McMahon and Peter R. Greene

It is certified that error appears in the above-identified patent and that said Letters Patent are hereby corrected as shown below:

Column 6, line 16, after "horse" change "and" to --or--;

Column 15, line 4, change "5/8" to --3/8--;

Column 16, line 64, change "degee" to --degree--

Signed and Sealed this

*Tenth* Day of *August 1982*

[SEAL]

*Attest:*

GERALD J. MOSSINGHOFF

*Attesting Officer* *Commissioner of Patents and Trademarks*